US007975843B2

(12) United States Patent
Rhodes

(10) Patent No.: US 7,975,843 B2
(45) **Date of Patent: *Jul. 12, 2011**

(54) PACKAGED SHEET MEDIA AND METHOD OF USING SAME

(75) Inventor: Hayden Rhodes, Hertford (GB)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/707,374

(22) Filed: Feb. 17, 2010

(65) Prior Publication Data

US 2010/0140118 A1 Jun. 10, 2010

Related U.S. Application Data

(63) Continuation of application No. 11/289,129, filed on Nov. 29, 2005, now Pat. No. 7,695,037.

(51) Int. Cl.
*B65D 75/02* (2006.01)
*B65D 75/56* (2006.01)
*B65B 27/08* (2006.01)

(52) U.S. Cl. ..... 206/214; 206/451; 206/449

(58) Field of Classification Search ..... 206/215, 206/424, 214, 425, 451, 449, 494, 804; 294/138, 294/137, 149, 165, 150, 170; 220/754; 271/145, 271/161; 414/801

See application file for complete search history.

(56) References Cited

U.S. PATENT DOCUMENTS

| | | | | |
|---|---|---|---|---|
| 1,909,407 | A * | 5/1933 | Hudson | 206/494 |
| 2,199,676 | A | 4/1938 | Salsman | |
| 4,444,315 | A * | 4/1984 | Gaskill, Jr. | 206/449 |
| 4,830,186 | A * | 5/1989 | George et al. | 206/449 |
| 4,895,295 | A * | 1/1990 | Montgomery et al. | 294/165 |
| 4,958,759 | A * | 9/1990 | Jarvis | 224/153 |
| 4,998,620 | A * | 3/1991 | Taylor | 206/440 |
| 5,022,316 | A * | 6/1991 | Hellwig | 100/34 |
| 5,079,803 | A * | 1/1992 | Moore | 24/16 R |
| 5,169,199 | A * | 12/1992 | de Ruyter et al. | 294/149 |
| 6,029,425 | A * | 2/2000 | Dunn | 53/449 |
| 6,044,975 | A | 4/2000 | Dirx et al. | |
| 6,045,159 | A * | 4/2000 | Bellah | 281/29 |
| 6,187,403 | B1 * | 2/2001 | Richardson | 428/40.1 |
| 6,604,618 | B1 * | 8/2003 | Godshaw et al. | 190/107 |
| 7,367,490 | B2 * | 5/2008 | Forthaus et al. | 229/117.24 |
| 7,487,873 | B2 * | 2/2009 | Larsson et al. | 206/494 |
| 7,695,037 | B2 * | 4/2010 | Rhodes | 294/156 |
| 2002/0066689 | A1 * | 6/2002 | Lando | 206/499 |
| 2009/0321293 | A1 * | 12/2009 | Latvala | 206/449 |

* cited by examiner

*Primary Examiner* — Steven A. Reynolds
(74) *Attorney, Agent, or Firm* — Fay Sharpe LLP

(57) ABSTRACT

A package of sheet media includes a stack of individual sheets of media and a packaging wrap extending at least partially around the stack. An outer wrap at least partially covering the stack and the packaging wrap can optionally be used. A method of loading the package of sheet media on a printing system is also provided.

20 Claims, 5 Drawing Sheets

PACKAGED SHEET MEDIA AND METHOD OF USING SAME

This application is a continuation of U.S. patent application Ser. No. 11/289,129, filed on Nov. 29, 2005, which is hereby incorporated herein by reference in its entirety.

BACKGROUND

The terms "print", "printing" and "marking" as used herein are to be broadly interpreted to encompass any action or process involving the production or output of sheet media having text, images, graphics and/or other indicia formed thereon by any process, such as ink jet or electrophotographic processes, for example. The terms "printer" and "printing system" as used herein are to be broadly interpreted to encompass any device, apparatus or system that is loaded or otherwise utilizes one or more stacks of sheet media and is capable a "printing" action. Examples of such equipment and/or systems include, without limitation, desktop printers, network printers, standalone copiers, multi-function printer/copier/facsimile devices, and high-speed printing/publishing systems. Additionally, such sheet media can be of any type or kind, such as paper or polymeric film, for example. Furthermore, such exemplary embodiments of equipment and/or systems can output indicia on the sheet media using any printing or marking substance, such as ink, toner or colorant, for example, in monochrome (e.g., black) or one or more colors, or any combination thereof.

Printing systems are well known and commonly available in a wide variety of types, kinds and configurations. Volumes of paper and other media are processed each day using such printing systems, generally with minimal problems and/or difficulties. However, discontinuities in performance and operation do occur in these printing systems and such occurrences are sometimes attributed to jams caused by misfeeds or multi-feeds of the sheet media being used, such as paper, polymeric transparencies or other media.

Significant efforts have been directed to improving media transport pathways and components, and considerable improvements have been achieved. It seems, however, that less attention has been paid heretofore to improving the condition of the media itself, and particularly the state of the media at the time of loading into a component of the printing system, such as a media supply tray.

As an example, adhesion between adjacent sheets of media can often occur as a result of manufacturing and/or packaging processes. This condition is sometimes referred to as "edge weld", and it can cause multiple sheets of media to be simultaneously drawn into and/or fed along the media pathway. This is undesirable and occasionally results in the printing system undergoing an operational discontinuity. To minimize the difficulties encountered due to edge weld and/or other undesirable conditions, instructions and training are often provided that include techniques for preparing and loading sheet media into a printing system. Such techniques, however, may not be performed correctly or, in some cases, may not be performed at all. As such, the undesirable conditions of the sheet media discussed above often remain present and result in performance discontinuities which are desirable to avoid.

Another issue associated with the loading of sheet media into a component of a printing system, such as a media supply tray, is the physical challenge of fitting the stack of sheet media into the tray. For sheets of media to be correctly and consistently drawn into and fed along the media pathways of the printing system, it is desirable for the supply of sheet media to be captured within the tray or other supply component. This assists in maintaining a consistent orientation of the media within the tray for uniform presentation of the sheets of media to the feeding mechanism. As such, the tray and/or component parts thereof are normally adjusted to closely fit around the sheet media stored therein. Unfortunately, this arrangement often makes the proper loading a stack of sheet media into the tray a challenging task.

Due to the difficulties of loading an entire stack of media into the supply tray at one time, other techniques are attempted by users and/or operators of printing systems. For example, in one such technique a stack of sheet media is divided into smaller portions, which are then individually loaded into the supply tray. While these portions are usually somewhat more manageable to physically handle, the resulting load of sheet media will normally consist of multiple small portions that are often not uniformly stacked and may have considerable variability in orientation and/or presentation to the feeding mechanism. As a result, misfeeds, multi-feeds and other conditions can occur and result in performance discontinuities.

The embodiments of packaged sheet media and method of using the same of the present disclosure have been developed to overcome these and other problems and disadvantages.

BRIEF DESCRIPTION

A package of sheet media in accordance with the present disclosure is provided and includes a stack of sheet media and a wrapping layer. The stack having a stack length, a stack width and a stack height. The wrapping layer extending around the stack along the stack height and one of the stack length and the stack width such that the other of the stack length and stack width remains exposed by the wrapping layer.

A ream of paper packaged for use on an associated paper tray of an associated printing system is provided and includes a stack of from about 475 to about 525 sheets of paper, a first wrap formed from paper, and a second wrap formed from paper. The stack includes a top, a bottom, a first end, an opposing second end, a first side and an opposing second side. The first wrap has a central portion extending between opposing end portions and is disposed around the stack with the opposing end portions secured together along one of the top and the bottom of the stack. The second wrap covers substantially all of the top, the bottom, the first end, the second end, the first side and the second side of the stack.

A method of loading a stack of sheet media into a media supply tray of a printing system is provided and includes providing a packaged stack of sheet media including a stack of individual sheets of media and an inner wrapping layer extending around a portion of the stack of sheets. The method also includes loading the stack of sheets into the associated paper tray using the inner wrapping layer. The method further includes removing the inner wrapping layer.

DETAILED DESCRIPTION

Figure 1:
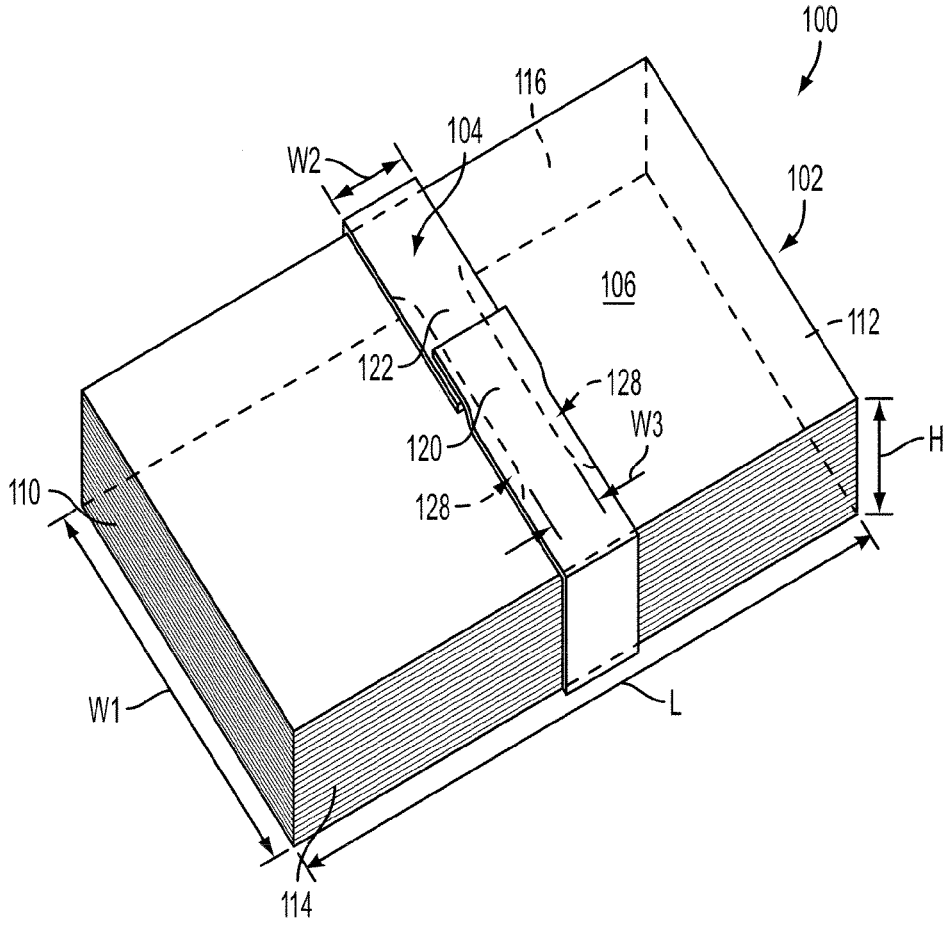
FIG. 1 is a perspective view of one exemplary embodiment of a stack of sheet media packaged in accordance with the present disclosure.

Turning now to the drawings wherein the showings are for the purpose of illustrating exemplary embodiments and not for limiting the same, FIG. 1 illustrates a package of sheet media 100 including a stack 102 of individual sheets of media and a packaging wrap or wrapping layer 104 secured therearound. Stack 102 is shown in FIG. 1 as having a length indicated by dimension L, a width indicated by dimension W1 and a height indicated by dimension H. Also, stack 102 has six sides, which include a top 106, a bottom 108 (FIG. 3), opposing ends 110 and 112, as well as opposing sides 114 and 116. In one exemplary embodiment, top 106 and bottom 108 can be respectively formed from a top-most sheet and a bottom-most sheet of the stack of sheets of media. In one preferred embodiment, stack 102 is formed from a plurality of sheets of substantially the same material, such as paper or polymeric material, for example, with each individual sheet having substantially the same dimensions as the length and width of stack 102. However, other stack compositions can alternately be used. It will be further appreciated that the height of stack 102 is attributed to the number of sheets forming the stack and the corresponding thickness of each sheet, which in one exemplary embodiment is substantially uniform from sheet to sheet. It will be appreciated that any suitable number of sheets can be used. As one example, a stack of from about 475 sheets to about 525 sheets can be used. One example of such a quantity is commonly available in the form of a ream of about 500 sheets of media, such as sheets of paper, for example.

Figure 2:
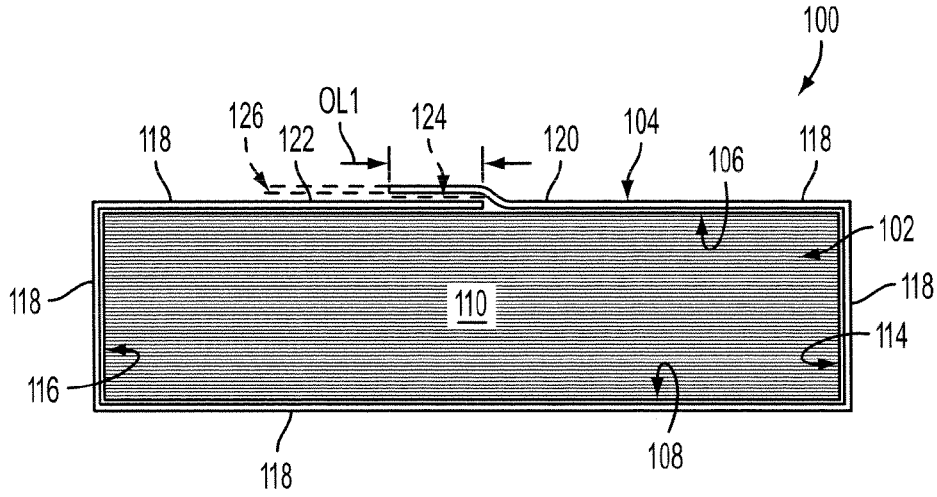
FIG. 2 is an end view of the stack of sheets of media in FIG. 1.

Packaging wrap or wrapping layer 104 includes a central portion 118 extending between opposing end portions 120 and 122. As shown in FIG. 2, central portion 118 extends around a substantial portion of stack 102. End portions 120 and 122 extend the remainder of the distance around stack 102 and in one exemplary embodiment at least partially overlap one another, as indicated by dimension OL1. In one exemplary embodiment, the overlapping portions are secured together in a suitable manner, such as by using an adhesive 124, for example. Additionally, an optional free end 126 can be provided that extends beyond the overlapping area secured using adhesive 124. Free end 126, if provided, can be used to tear apart or otherwise separate the secured end portions. As shown in FIG. 2, the optional free end extends outwardly along the wrap or wrapping layer opposite stack 102.

Figure 3:
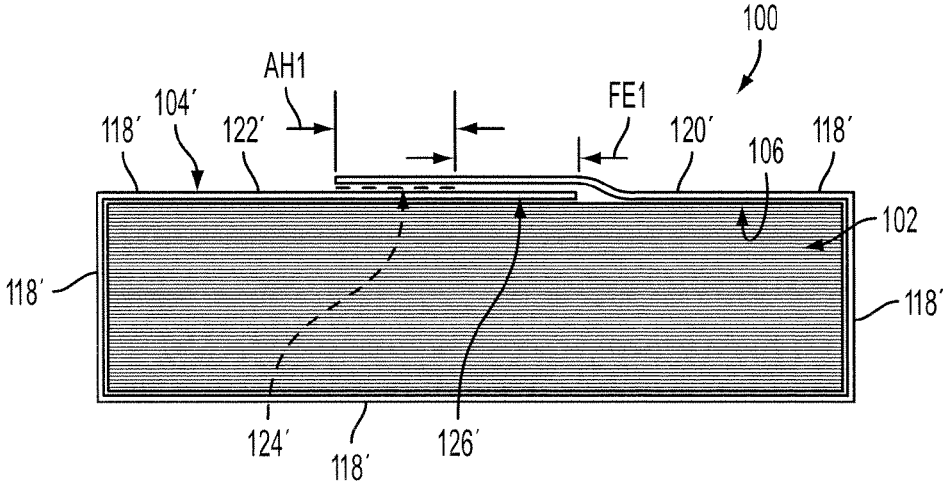
FIG. 3 is an end view of an alternate embodiment of the stack of sheet media in FIGS. 1 and 2.

An alternate embodiment of wrapping layer 104 is shown in FIG. 3 as packaging wrap or wrapping layer 104'. This alternate embodiment differs from wrapping layer 104 in that free end 126' is disposed inside the wrapping layer adjacent top 106 of stack 102 rather than being disposed outwardly thereof as shown in FIG. 2. Wrapping layer 104' includes a central portion 118' extending between opposing end portions 120' and 122'. Ends 120' and 122' at least partially overlap one another, and an adhesive 124' is disposed along at least a portion of the overlap, as indicated by dimension AH1. The remaining portion of the overlap, if provided, establishes the optional free end, as indicated by dimension FE1.

Turning again to FIG. 1, wrapping layer 104 is shown as having a width W2, which can be any suitable distance. It will be recognized that the greater the width of the wrapping layer, the more strength the wrap will have, the more stable the stack will be when lifted thereby, and the less likely it will be for sheets to inadvertently slip out of the wrapping layer. However, the greater the width of the wrapping layer, the more difficult it is likely to be for an operator or user to grasp the same. In some cases, excessive width may lead to crumpling or inadvertent tearing of the wrapping layer. As such, one of skill in the art will recognize the benefits of optimizing the width of the wrapping layer to balance the associated factors and considerations. For example, the skilled artisan may choose to maximize one or more of strength, stability, sheet retainment and comfort, and minimize one or more of cost and inadvertent tearing. One example of a suitable range for width W2 is from approximately ¼ of an inch to approximately 4 inches. However, it is to be distinctly understood that any suitable distance or range of distances can be used. One possible way of increasing the comfort of grasping wrapping layer 104 (and/or wrapping layer 104') is to include an area of reduced width formed therealong. This may permit the wrapping layer to be grasped with greater comfort and less wrinkling of the wrapping layer material. One example of such an area of reduced width is indicated by optional cutouts 128 that, if provided, reduce the width of wrapping layer 104 to a reduced width W3 along a portion thereof.

Wrapping layers 104 and 104' are preferably of a sufficient length to extend around stack 102, such as across top 106, bottom 108 and opposing sides 114 and 116, for example, or across top 106, bottom 108 and opposing ends 110 and 112, for example. Thus, it will be appreciated that wrapping layer 104 (or wrapping layer 104') will have a minimum length of twice the height H of the stack plus either twice the width W1 of the stack or twice the length L of the stack. Additionally, one exemplary embodiment of the wrapping layer includes enough additional material to form an overlap portion suitable for securing the ends of the wrapping layer together, as indicated by dimension OL1 in FIG. 2. One example of a suitable range for dimension OL1 is from about ⅛ of an inch to about 3 inches. However, it will be appreciated that any suitable length or dimension can alternately be used. Additionally, the length of the wrapping layer can be further increased to provide a free end, such as free end 126 or 126'. One example of a suitable length for the free end is from about ¼ of an inch to about 3 inches. Again, however, it will be appreciated that any suitable length or dimension can alternately be used.

Wrapping layers 104 and 104' can be formed from any suitable material or combination of materials. For example, the wrapping layer could be formed from either a paper, such as a recycled paper stock, for example, or a polymeric material. What's more, wrapping layers 104 and 104' are shown as being formed from a unitary length of material. It will be appreciated, however, that in other exemplary embodiments wrapping layers 104 and 104' can be formed from two or more lengths of material that are joined together to form a wrapping layer having an overall length sufficient to extend around the stack of sheet media. As such, a packaged stack of sheet media could include two or more joints, such as is the overlap portion identified by dimension OL1, for example, joining the two or more lengths of material. In such an arrangement, it would be possible to dispose an overlap portion along each of the top and bottom of the stack for convenient separation of the joint. However, any other suitable positioning or orientation could alternately be used.

In the exemplary embodiment shown in FIG. 1, one or more of cutout portions 128 extend along the end portions and overlap area of the wrapping layer. Alternately, the one or more cutout portions, if provided, can be disposed anywhere along the wrapping layer, such as along central portion 118 (or 118'), for example. However, if an area of reduced width is provided, it is preferable that the same be disposed along one of top 106 and bottom 108. What's more, the end portions and corresponding overlap area can be disposed anywhere along or around the stack. However, if a free end is provided for tearing apart or otherwise separating the wrapping layer, it will be preferable for the free end to be accessible once the package of sheet media has been loaded into an associated media supply tray.

Figure 4:
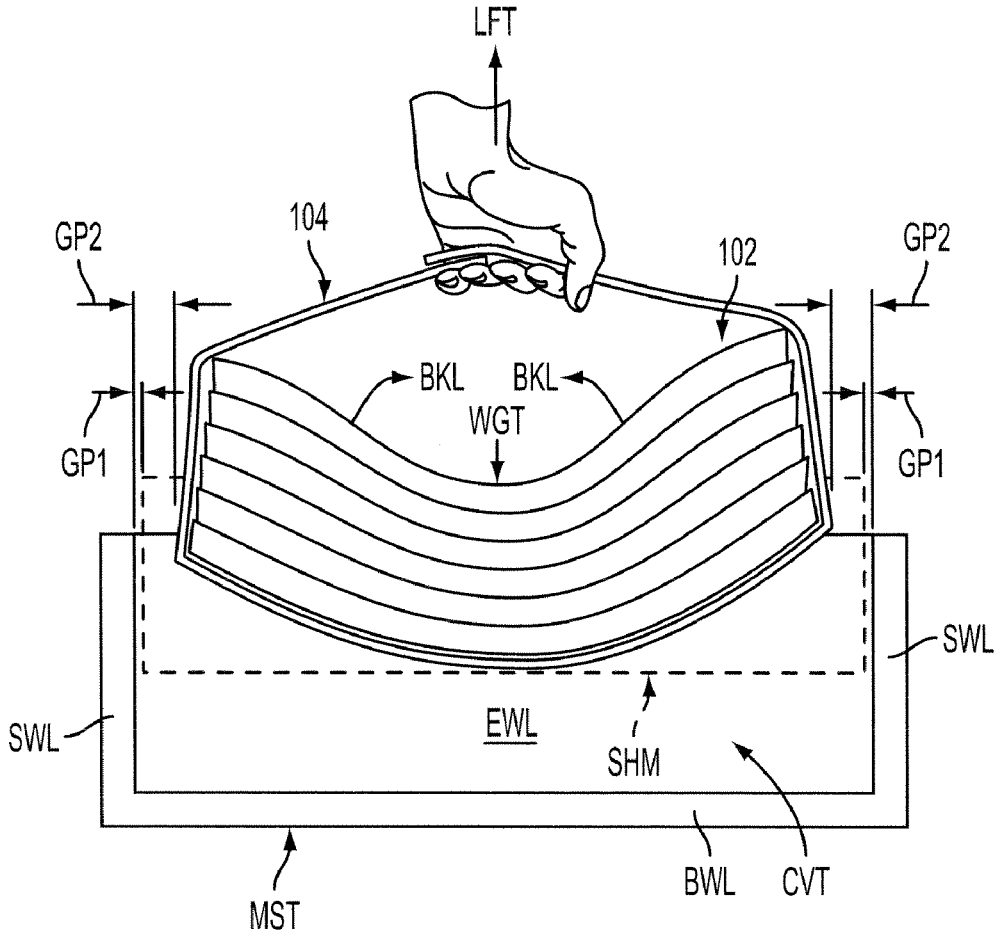
FIG. 4 is an end view of the stack of sheet media in FIGS. 1 and 2 shown being loaded into an associated media supply tray.

FIG. 4 illustrates a stack of sheet media, such as stack 102, for example, being loaded into an associated media supply tray MST, which includes a bottom wall BWL, opposing side walls SWL and opposing end walls EWL (only one of which is shown in FIG. 4). The walls of media supply tray MST define a tray cavity CVT that receives the stack of sheet material, which is generally indicated by dashed line SHM being loaded in a conventional manner. It will be appreciated that the tray cavity CVT is dimensioned to closely receive the stack of sheet material SHM, as indicated by dimensions GP1 extending between the stack of sheet material and the side walls of the supply tray. As discussed above, such arrangements can present various challenges and/or difficulties in or with loading the stack of sheet material into the media supply tray.

Wrapping layer 104 (or 104') is shown in FIG. 4 in use supporting stack 102. By lifting stack 102 using wrapping layer 104, as indicated by arrow LFT, the weight of the stack, indicated by arrow WGT, causes the stack to buckle or otherwise flex as indicated by arrows BKL. In supporting the stack of sheet material in this manner, each sheet is subjected to one or more radii of slightly different curvatures. These variations in number and length of radii are operative to change or alter the dimension across which the flexing or buckling occurs. As a result, a shingling effect occurs in the sheets of the stack, which is indicated by the stepped edges of the sheets in FIG. 4. It will be appreciated that the coarse shingling effect shown is merely illustrative and that a finer shingling effect will normally occur.

Additionally, the buckling or flexing of the stack reduces an overall dimension of the stack such that increased clearance between the side walls of the media supply tray and the stack is formed, as indicated by dimensions GP2. Thus, the stack of sheet media can be more easily loaded into the cavity of the supply tray. Upon releasing the wrapping layer and stack of sheet media into the cavity of the supply tray, the stack reverts to its substantially rectangular shape having the minimal clearance with the walls of the supply tray, as indicated by dimensions GP1. Thereafter, the wrapping layer can be torn or otherwise separated and removed from around the stack of sheet material.

Figure 5:
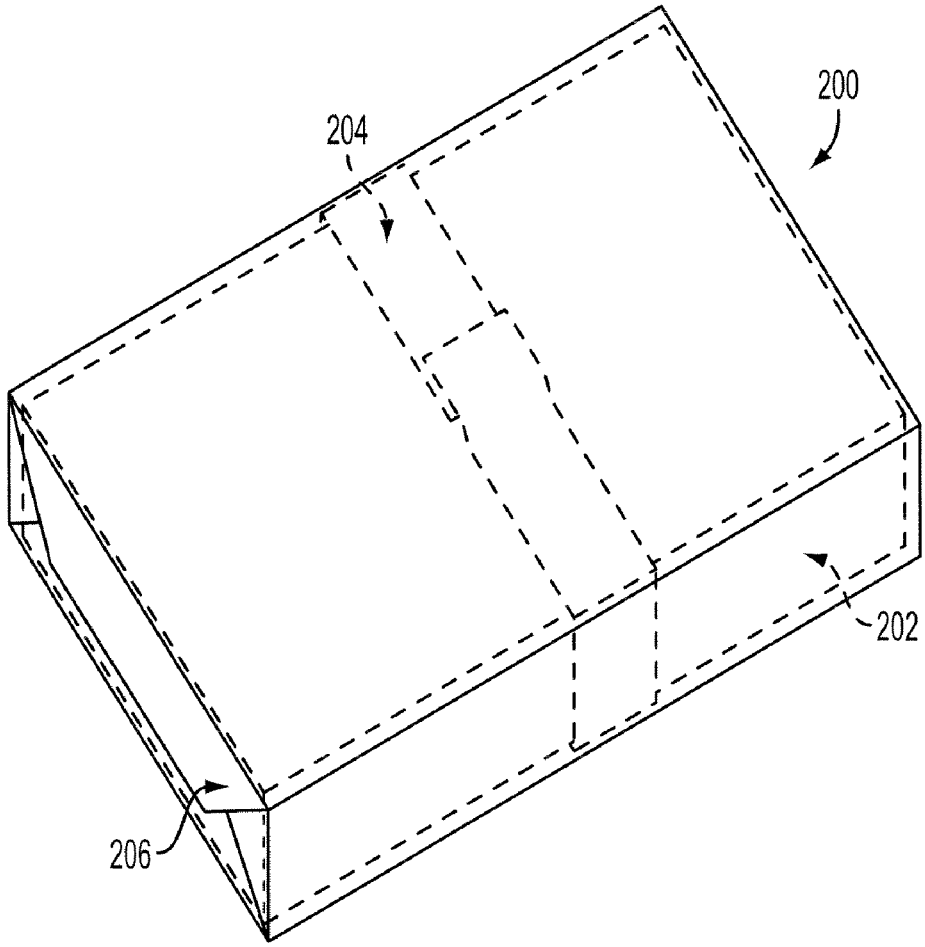
FIG. 5 is a perspective view of another exemplary embodiment of a stack of sheet media in accordance with the present disclosure.

Another embodiment of a package of sheet material 200 is shown in FIG. 5 and includes a stack of sheet material 202, a first or inner wrapping layer 204 and a second or outer wrapping layer 206. Stack of sheet material 202 and inner wrapping layer 204 are substantially identical to stack 102 and wrapping layers 104 and 104' discussed above. Package 200 differs from package 100 in that a second or outer wrapping layer 206 extends along at least a portion of each of the top, bottom, ends and sides of the stack. Outer wrapping layer 206 can be formed from any suitable material suitable for storage and transport of the sheet material as is well understood by those of skill in the art. In one exemplary embodiment, outer wrapping layer 206 is formed from paper, such as recycled paper, for example. However, other materials, such as polymeric wrapping materials, for example, can alternately be used.

Figure 6:
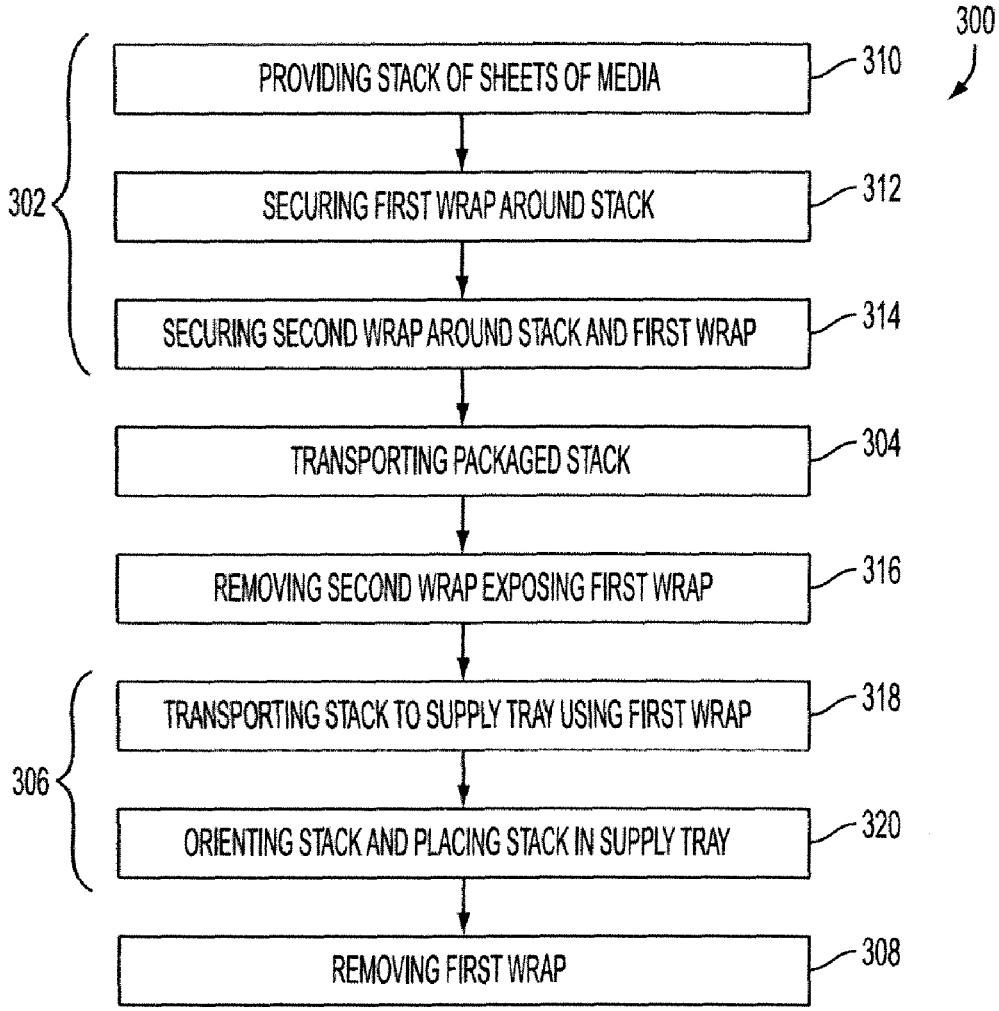
FIG. 6 is a flow chart of one exemplary embodiment of a method in accordance with the present disclosure.

FIG. 6 illustrates one exemplary method 300 of loading a stack of sheets of media into a media supply tray of a printing system. Method 300 includes providing a packaged stack of sheet media, such as packaged stack 100 having wrapping layer 104 or 104', for example, as indicated by item number 302. Method 300 can optionally include transporting the packaged stack, such as by delivering packaged stacks to a location or by localized distribution of the packaged stacks at a location, for example, as indicated by item number 304. Method 300 also includes loading the packaged stack into a media supply tray using the packaging on the stack, such as wrapping layer 104, 104' or 204, for example, as indicated by item number 306. Method 300 further includes removing packaging, such as wrapping layer 104, 104' or 204, for example, from the stack, as indicated by item number 308.

Providing a packaged stack of sheet media in item number 302 can optionally include providing an unpackaged stack of individual sheets of media, as indicated by item number 310, and securing a first wrap or inner wrapping layer, such as wrapping layer 104, 104' or 204, around the stack of sheet media as indicated by item number 312. Providing a packaged stack of sheet media in item number 302 can also optionally include securing a second wrap or outer wrapping layer, such as wrapping layer 206, for example, around the stack of sheet material and the first wrap or inner wrapping layer, as indicated by item number 314.

If item number 304 is included and the outer wrapping layer is provided, transporting the packaged stack in item number 304 can include transporting the stack while the same is covered by both the inner and outer wrapping layers. Furthermore, if the optional outer wrapping layer is provided, method 300 can include removing the outer wrapping layer exposing the inner wrapping layer, as indicated by item number 316.

Loading the packaged stack of sheet media in item number 306 can optionally include transporting the stack of sheet media to the media supply tray using the first wrapping layer, as indicated by item number 318. Furthermore, loading the packaged stack of sheet media in item number 306 can optionally include orienting the stack of sheet media relative to the media supply tray and placing the stack in or on the media supply tray, as indicated by item number 320. Thereafter, item number 308 can be performed.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A package of sheet media comprising:

a stack of individual sheets of media, said stack having a top sheet, a bottom sheet, a pair of stack ends at least partially defining a stack length, a pair of stack sides at least partially defining a stack width, and a stack height defined between said top and bottom sheets; and, a wrapping layer extending around said stack in one of a lengthwise direction and a widthwise direction such that a respective one of said pair of stack sides and said pair of stack ends remains exposed by said wrapping layer;

said wrapping layer formed from a longitudinal length of material having a first portion and a second portion, said first portion having a first width and a first length that is greater than said first width such that said first portion extends longitudinally at approximately said first width for at least said first length, said second portion having a second width and a second length that is greater than said second width such that said second portion extends longitudinally at approximately said second width for at least said second length, said first width of said first portion being less than said length and less than said width of said stack such that at least a portion of said top sheet and said bottom sheet remain exposed by said wrapping layer and said second width of said second portion being less than said first width of said first portion such that a longitudinally-extending grasping area that is dimensioned for lifting and transporting said stack is at least partially formed along said wrapping layer by said second portion, said first portion being disposed in abutting engagement with at least said bottom sheet of said stack and said second portion disposed along at least said top sheet of said stack such that said wrapping layer will permit said stack to buckle and thereby reduce at least one of said stack length and said stack width during lifting and transporting of said stack by said wrapping layer.

2. A package of sheet media according to claim 1, wherein said wrapping layer extends around said stack in a widthwise direction, and said longitudinal length of said wrapping layer includes at least twice said width of said stack plus twice said height of said stack plus at least ⅛ of an inch as an overlap portion.

3. A package of sheet media according to claim 1, wherein said wrapping layer is a unitary length of material including opposing end portions secured to one another using an adhesive.

4. A package of sheet media according to claim 1, wherein said stack includes from about 475 to about 525 sheets of media.

5. A package of sheet media according to claim 1, wherein said wrapping layer is a first wrapping layer and said package of media further comprises a second wrapping layer disposed outwardly of said first wrapping layer and extending around said stack along said length, said width and said height of said stack.

6. A package of sheet media according to claim 5, wherein said second wrapping layer covers substantially all of said stack along said length, said width and said height.

7. A package of sheet media according to claim 5, wherein at least one of said first wrapping layer and said second wrapping layer is formed from paper.

8. A ream of paper packaged for use on an associated paper tray of an associated printing system, said ream of paper comprising:

a stack of sheets of paper, said stack including a top, a bottom, a first end, an opposing second end, a first side and an opposing second side;

a first wrap including a central portion extending between opposing first and second end portions, said first wrap disposed around said stack with said opposing end portions secured together along one of said top and said bottom of said stack such that said first wrap is capable of supporting said stack during transport thereof, said central portion having a first substantially-uniform width along an elongated length thereof, said first substantially-uniform width being less than a length and a width of said top and said bottom of said stack such that at least a portion of each thereof remain exposed by said first wrap, said first end portion and said second end portion each having a second substantially-uniform width along an elongated length thereof, said second substantially-uniform width of said first and second end portions being less than said first substantially-uniform width of said central portion and being approximately equal to one another, said first and second end portions at least partially overlapping one another such that an elongated grasping area having approximately said second substantially-uniform width of said first and second end portions is formed thereby along said first wrap, said first wrapping layer formed from a strip of material capable of permitting said stack to buckle upon application of a lifting force and thereby reduce a dimension of said stack between at least one of said first and second ends and said first and second sides; and, a second wrap disposed outwardly of said first wrap and covering substantially all of said top, said bottom, said first end, said second end, said first side and said second side of said stack.

9. A ream of paper according to claim 8, wherein said first wrap extends around said stack along said top, said bottom and said first and second sides.

10. A ream of paper according to claim 8, wherein at least said first substantially-uniform width of said central portion of said first wrap is within a range of from approximately ¼ of an inch to approximately 4 inches.

11. A ream of paper according to claim 8, wherein said opposing first and second end portions of said first wrap are secured together using an adhesive.

12. A ream of paper according to claim 11, wherein at least one of said opposing first and second end portions extends outwardly beyond said adhesive forming a free end portion.

13. A ream of paper according to claim 8, wherein said first wrap is formed from a unitary length of material that includes said central portion and said opposing first and second end portions.

14. A package of sheet media comprising:

a stack of individual sheets of media, said stack having a stack length, a stack width and a stack height; and, a wrapping layer formed from a longitudinal strip of material and extending longitudinally around said stack in a direction at least approximately aligned with one of said stack length and said stack width such that at least a portion of said stack remains exposed by said wrapping layer, said wrapping layer including a first longitudinally-extending portion having a first substantially-uniform width extending therealong and a second longitudinally-extending portion having a second substantially-uniform width extending therealong, said first width of said first portion being less than said stack length and less than said stack width such that at least a portion of a top sheet and a bottom sheet of said stack remain exposed by said wrapping layer and said second width being less than said first width of said first portion such that a longitudinally-extending grasping area that is dimensioned for lifting and transporting said stack is at least partially formed along said wrapping layer by said second portion, said wrapping layer permitting said stack to buckle and thereby reduce at least one of said stack length and said stack width.

15. A package of sheet media according to claim 14, wherein said wrapping layer is a first wrapping layer and said package of media further comprises a second wrapping layer disposed outwardly of said first wrapping layer and extending around said stack along said length, said width and said height of said stack.

16. A package of sheet media according to claim 15, wherein said second wrapping layer covers substantially all of said stack along said length, said width and said height.

17. A package of sheet media according to claim 14, wherein said wrapping layer is formed from a unitary length of material that includes at least said first and second portions.

18. A package of sheet media according to claim 14, wherein said wrapping layer includes a third longitudinally-extending portion disposed adjacent said first portion in a direction opposite said second portion, said third portion having a third substantially-uniform width extending therealong, said third width being approximately equal to one of said first width of said first portion and said second width of said second portion.

19. A package of sheet media according to claim 18, wherein said third width is approximately equal to said second width and said second and third portions of said first wrapping layer at least partially overlap one another to form said longitudinally-extending grasping area.

20. A package of sheet media according to claim 18, wherein said second and third portions are secured together using an adhesive and a section of one of said second and third portions extends outwardly beyond said adhesive forming a free end of said one of said second and third portions.

* * * * *